US006940533B2

(12) United States Patent
Burdenko

(10) Patent No.: US 6,940,533 B2
(45) Date of Patent: Sep. 6, 2005

(54) THERMAL PRINT HEAD ALIGNMENT METHOD AND APPARATUS

(75) Inventor: Michael N. Burdenko, Wellesley, MA (US)

(73) Assignee: Polaroid Corporation, Waltham, MA (US)

( * ) Notice: Subject to any disclaimer, the term of this patent is extended or adjusted under 35 U.S.C. 154(b) by 42 days.

(21) Appl. No.: 10/743,234

(22) Filed: Dec. 22, 2003

(65) Prior Publication Data

US 2004/0141044 A1 Jul. 22, 2004

Related U.S. Application Data

(60) Provisional application No. 60/436,353, filed on Dec. 23, 2002.

(51) Int. Cl.[7] ..... B41J 25/304

(52) U.S. Cl. ..... 347/198

(58) Field of Search ..... 347/197, 198; 400/120.16, 120.17, 82

(56) References Cited

U.S. PATENT DOCUMENTS

| | | | | |
|---|---|---|---|---|
| 5,038,155 A | | 8/1991 | Yamagishi et al. | 346/76 PH |
| 5,138,336 A | * | 8/1992 | Goto | 347/198 |
| 6,298,783 B1 | | 10/2001 | O'Mera et al. | 101/486 |

* cited by examiner

*Primary Examiner*—Huan Tran

(57) ABSTRACT

There is described a device for mounting a thermal print head. The device comprises a frame including a reference member and a multiplicity of adjustable datum points oriented orthogonally around a mounting location for a thermal print head. The datum points are adapted for adjustment to precisely position a thermal print head in the mounting location with respect to the reference member.

11 Claims, 5 Drawing Sheets

THERMAL PRINT HEAD ALIGNMENT METHOD AND APPARATUS

REFERENCE TO RELATED APPLICATIONS

This application claims the benefit of provisional application Ser. No. 60/436,353, filed Dec. 23, 2002.

TECHNICAL FIELD

The present invention relates to thermal print head assemblies, and particularly to the alignment of the thermal print heads in those assemblies.

BACKGROUND OF THE INVENTION

Modern thermal print heads have achieved levels of resolution based upon integrated circuit construction techniques which can locate a great number of individual heating elements in close proximity to each other. This advantage of resolution creates a limitation on the total span of the print head due to the possibility of faults occurring in the semiconductor, both in the manufacturing process and later in the printing application. Larger print spans have been achieved by aligning two or more smaller print heads to achieve the wider span. Also, due to the resolution achieved, relatively small misalignment between such multiple print heads is easily noticed in the resulting printed product. Even misalignments of as little as one pixel can be visually determined.

SUMMARY OF THE INVENTION

One aspect of the present invention relates to a device for mounting a thermal print head, comprising a frame including a reference member; and a multiplicity of adjustable datum points oriented orthogonally around a mounting location for a thermal print head, wherein the datum points are adapted for adjustment to precisely position a thermal print head in the mounting location with respect to the reference member.

The device may include one or more bias mechanisms adapted for biasing a thermal print head in the mounting location against the multiplicity of adjustable datum points. The device may further include a securable device for fixing the location of a print head in the mounting location while it is biased against the multiplicity of adjustable datum points.

The device may further comprise a calibration tool having a first portion shaped like a thermal print head for placement in the mounting location and a rigid positioning member extending from the first portion, wherein the positioning member is adapted to abut the reference member of the frame for precisely positioning the first portion in the mounting location while the datum points are adjusted to determine the position of thermal print heads to be later installed in the mounting location. The reference member may include a substantially flat surface and a cylindrical element mounted parallel to said substantially flat surface.

In another aspect the invention relates to a method for aligning one or more thermal print heads to a print head assembly, including the steps of providing a frame having a reference member and a multiplicity of adjustable datum points oriented orthogonally around a mounting location for a thermal print head, providing a calibration tool having a first portion shaped like a thermal print head for placement in the mounting location and a rigid positioning member extending from the first portion, locating the calibration tool with the first portion in the mounting location and the positioning member abutting the reference member of the frame for precisely positioning the first portion in the mounting location, and adjusting the datum points to determine a precise position for thermal print heads to be later installed in the mounting location.

The method may further include the step of attaching the calibration tool to the frame during the step of adjusting. The method may even further include the steps of removing the calibration tool from the frame after the step of adjusting and installing a thermal print head in the mounting location against adjusted datum points. The method may still further include mechanically biasing a printer head installed in the mounting location against the datum points. The method may also include securing the printer head in the mounting location against the datum points.

These variations provide improved thermal print head alignment, which is critical for multiple print head assemblies. This is achieved without the need for high accuracy fabrication of the assemblies.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
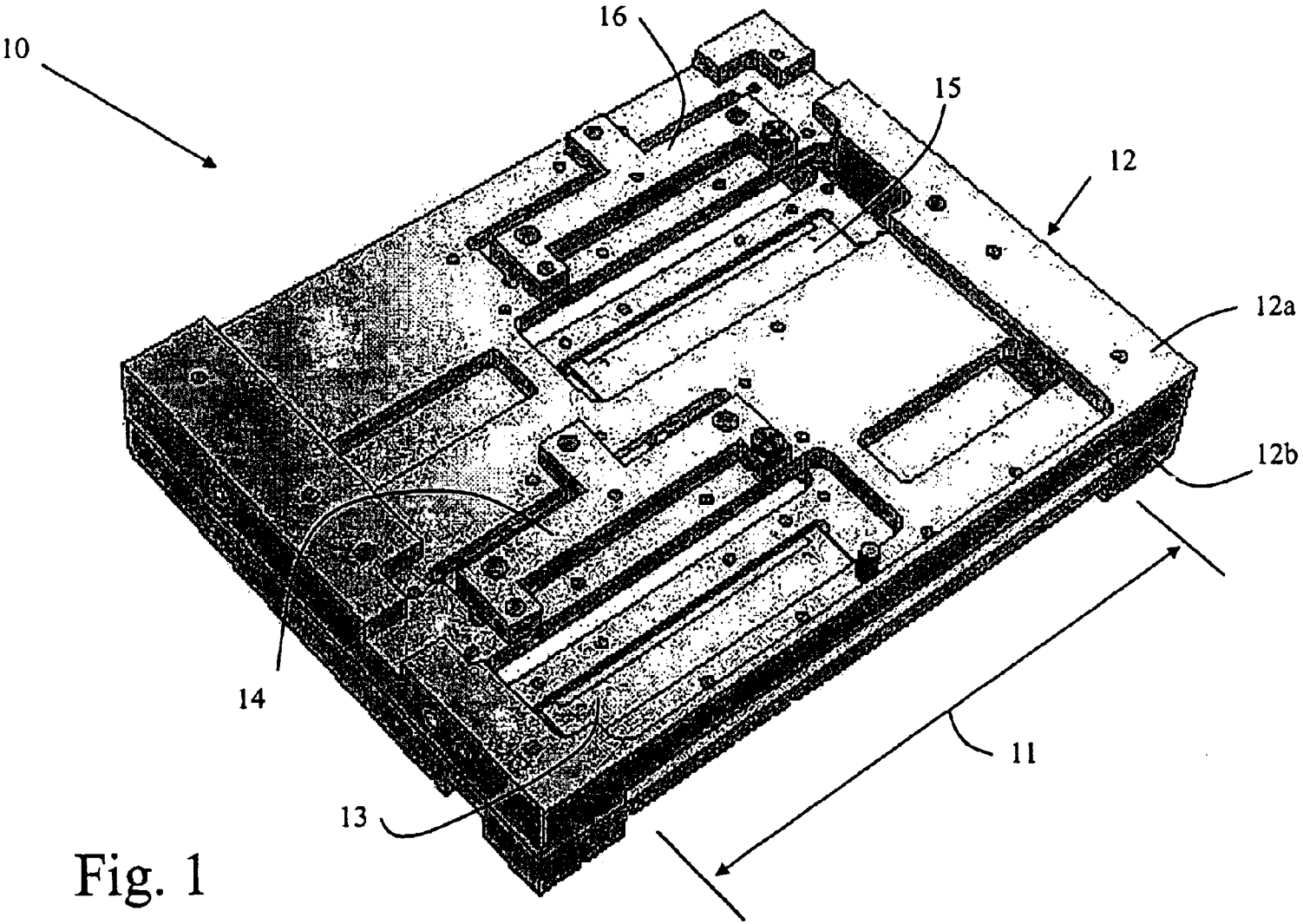
FIG. 1 is a perspective view of a thermal print head assembly on which are mounted a multiplicity of thermal print heads.

A thermal print head assembly 10 is shown in FIG. 1 and generally includes a mounting frame 12 and four installed print heads 13, 14, 15, 16. For purposes of this disclosure, all references to a thermal print head necessarily include a semiconductor portion (shown for print heads 13, 15) and a holder portion for that semiconductor (shown for print heads 14, 16). Frame 12 is made up of two sections 12*a*, 12*b*, with print heads 14, 16 mounted on frame section 12*a*. Frame section 12*b* is designed to oppose frame section 12*b* and mount the additional pair of print heads 13, 15 for printing on the opposite side of print media passing along a print media path 11.

Figure 2:
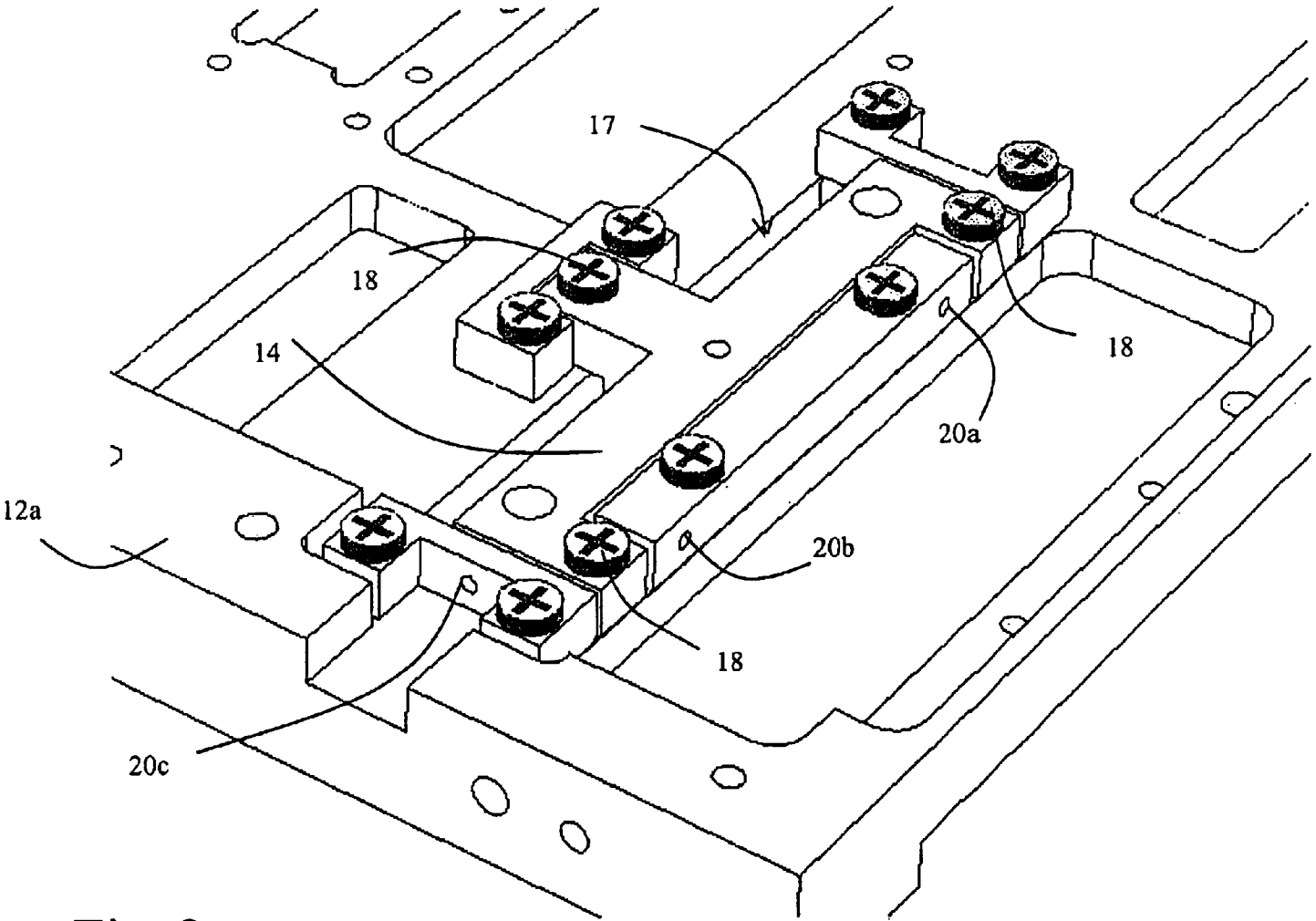
FIG. 2 is a perspective close up view of the assembly of FIG. 1.

FIG. 2 shows a close up view of thermal print head 14, which is mounted in a mounting location 17 and held in place by a multiplicity of screws 18. The position of thermal print head 14 within mounting location 17 is precisely determined by a multiplicity of set screws 20*a*, 20*b* and 20*c*. Set screws 20*a* and 20*b* are located along one elongated side of thermal print head 14, and set screw 20*c* is located along an orthogonal side relative to the elongated side. By use of this orthogonal arrangement, the location of thermal print head 14 can be precisely determined.

Figure 3:
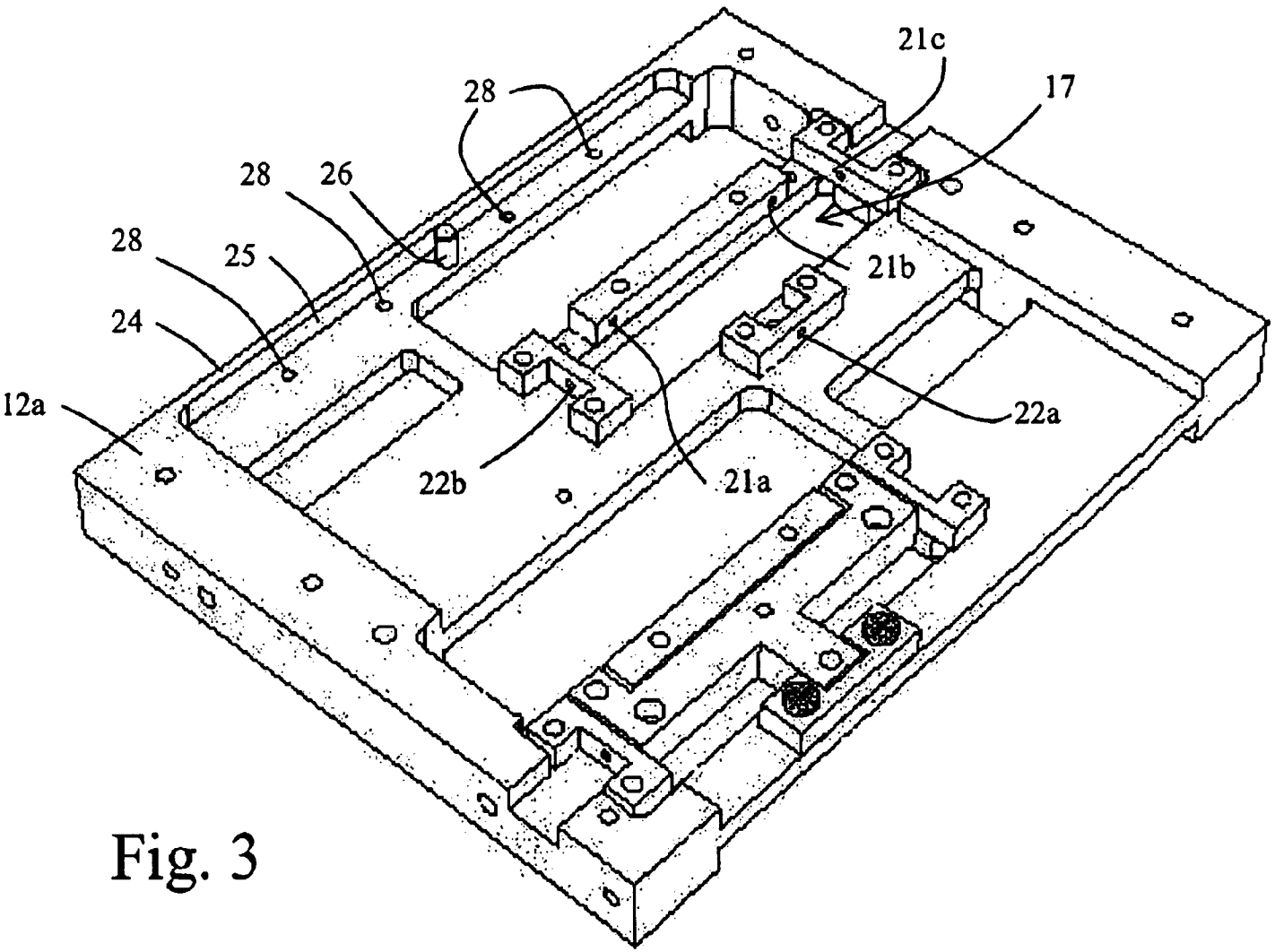
FIG. 3 is a perspective view of FIG. 2 taken from an opposing side.

FIG. 3 shows the same frame section 12*a* without print head 14 (FIG. 1), taken from an opposing angle. The absence of print head 14 in mounting location 17 exposes a multiplicity of datum points 21*a*, 21*b*, 21*c*, which are formed by set screws 20*a*, 20*b*, 20*c*, respectively. Also shown are a pair of spring loaded plungers 22*a*, 22*b*. Spring loaded plungers 22*a*, 22*b* extend into mounting location 16 and serve to bias a thermal print head against datum points 21*a*, 21*b* and 21*c* in two orthogonal directions. Each of the mounting locations for each of the print heads 13–16 includes the same sets of set screws, datum points and spring loaded plungers.

FIG. 3 further shows a reference member 24 having a substantially flat reference surface 25 and a cylindrical reference member 26 mounted parallel to said reference surface 25. Also shown are a mutiplicity of threaded screw holes 28.

Figure 4:
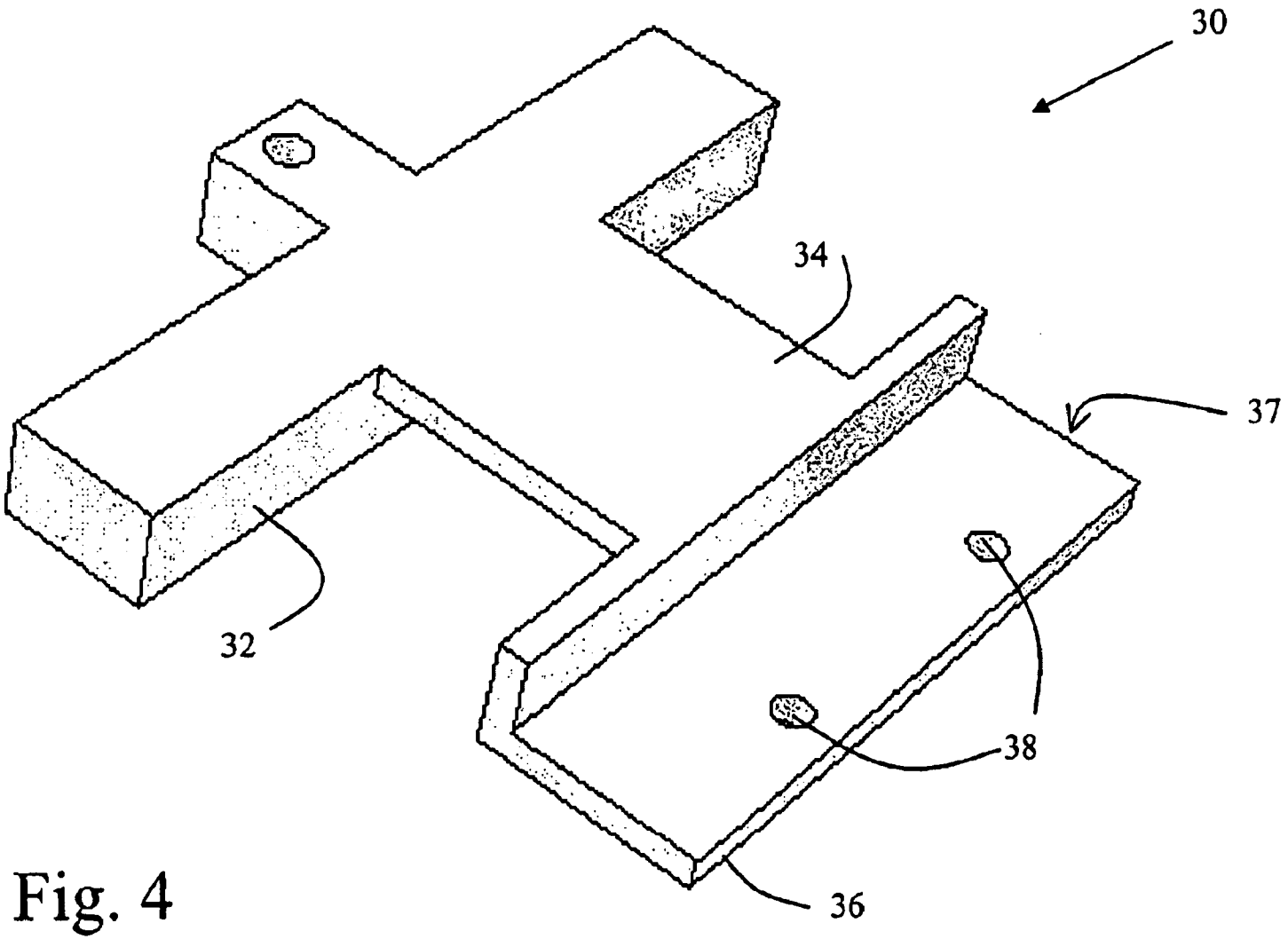
FIG. 4 is a perspective view of a calibration tool adapted for use in conjunction with the print head assembly of FIG. 1.

FIG. 4 shows a calibration tool 30, which is adapted for use in conjunction with the thermal print head assembly 10 (FIG. 1) for aligning the respective adjustable datum points 21*a*, 21*b*, 21*c* (FIG. 3) prior to the installation of a thermal print head 14 in assembly 10. Calibration tool 30 includes a first portion 32, which is shaped like at least a portion of a thermal print head, and a positioning member 34. Positioning member 34 includes reference surfaces 36, 37 and a pair of screw holes 38.

Figure 5:
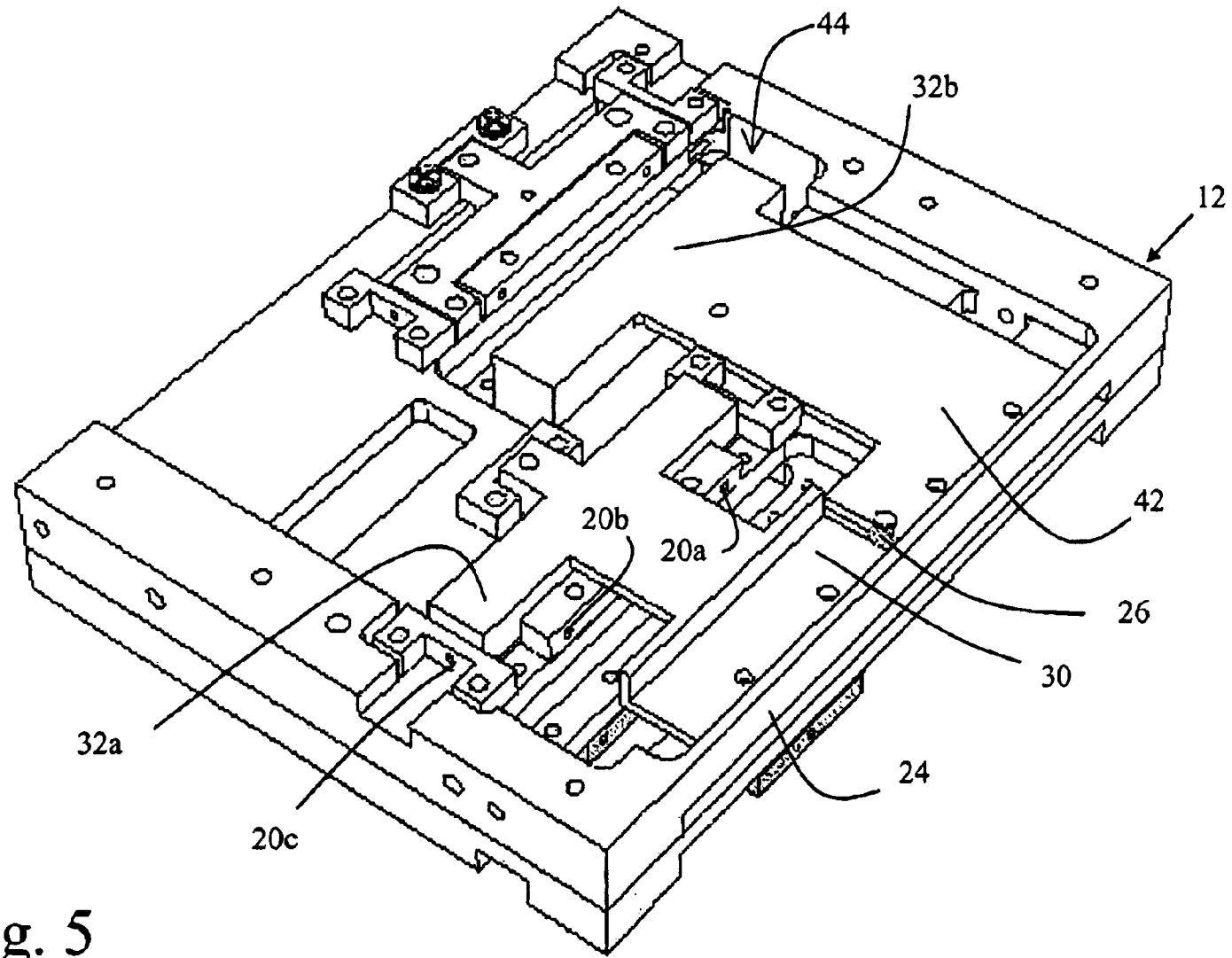
FIG. 5 is a perspective view of two calibration tools used in conjunction with the thermal print head assembly of FIG. 1.

FIG. 5 shows calibration tool 30 placed in frame 12 with the first portion 32 located in mounting location 17 in place of thermal print head 14. First portion 32 is aligned by reference surface 36 (FIG. 4) abutting reference surface 25 (FIG. 2) and reference surface 37 (FIG. 4) abutting cylindrical reference member 26. In this location, calibration tool 30 is secured using screw holes 38 and threaded screw holes 28 (FIG. 2) with screws (not shown). In this manner, first portion 32 is precisely aligned with respect to reference member 24. With calibration tool 30 in this location, set screws 20*a*, 20*b* and 20*c* are adjusted so that datum points 21*a*, 21*b*, 21*c* (FIG. 3) abut first portion 32 and thereby set the alignment position determined by calibration tool 30.

Once set screws 20*a*, 20*b*, 20*c* are properly adjusted, calibration tool 30 is removed and thermal print head 14 (FIG. 1) is placed in mounting location 17. In this position, the spring loaded plungers 22*a*, 22*b* physically bias thermal print head 14 against the datum points 21*a*, 21*b*, 21*c* determined by set screws 20*a*, 20*b*, 20*c*. With thermal print head 14 precisely aligned in this manner, screws 18 (FIG. 1) are installed to secure the position of thermal print head 14.

FIG. 5 further demonstrates how multiple print heads are calibrated within a single frame 12 to the same reference member 24. Another calibration tool 42 is shown providing reference for a mounting location 44 for print head 15. Calibration tool 42 is referenced against the same reference surface 25 and cylindrical reference member 26. In this manner, both print head mounting locations 17, 44 are calibrated to the same reference members and accurate manufacture of the frame becomes non-critical.

It should be noted that print head 15 (FIG. 1) is mounted on frame section 12*b*. Thus, all four print heads 13–16 are mounted in a single printing assembly 10 for two sided printing and may be easily and very accurately aligned using the very same reference surface 25 and cylindrical reference member 26, without the necessity of high accuracy in the manufacture of frame 12.

The present method and apparatus provide a highly repeatable alignment for thermal print heads 14, which alignment is on the order of 10 to 15 microns, or less than a typical pixel width. This approach further allows for the proper alignment without the necessity of high accuracy being machined into frame 12. Instead, the high degree of accuracy is simply machined into calibration tools 30, 42 which are retained and controlled by the manufacturer of the thermal printer. This approach to thermal printer alignment has proven to be very reliable and repeatable, allowing numerous print head installations and removals without the necessity of realigning the datum points. Even where realignment is necessary, a service representative can easily carry the calibration tool 30 and readily realign the datum points in very little time. This approach has the further advantage in that the calibration remains constant even if the semiconductor portions of the print heads are changed in their manufacture. The print head manufacturer need only control the alignment of the semiconductor portion within the holder portion.

Although the invention has been described in detail with respect to various preferred embodiments it is not intended to be limited thereto, but rather those skilled in the art will recognize that variations and modifications are possible which are within the spirit of the invention and the scope of the appended claims.

What is claimed is:

1. A device for mounting a thermal print head, comprising:

a frame including a reference member;

a multiplicity of adjustable datum points oriented orthogonally around a mounting location for a thermal print head, wherein said datum points are adapted for adjustment to precisely position a thermal print head in said mounting location with respect to said reference member; and one or more bias mechanisms adapted for biasing a thermal print head in said mounting location against said multiplicity of adjustable datum points.

2. The device of claim 1, further comprising a securable device for fixing the location of a print head in said mounting location while it is biased against said multiplicity of adjustable datum points.

3. The device of claim 1, wherein said multiplicity of adjustable datum points are lockable screws.

4. A device for mounting a thermal print head, comprising:

a frame including a reference member;

a multiplicity of adjustable datum points oriented orthogonally around a mounting location for a thermal print head, wherein said datum points are adapted for adjustment to precisely position a thermal print head in said mounting location with respect to said reference member; and a calibration tool having a first portion shaped like a thermal print head for placement in said mounting location and a rigid positioning member extending from said first portion, wherein said positioning member is adapted to abut said reference member of said frame for precisely positioning said first portion in said mounting location while said datum points are adjusted to determine the position of thermal print heads to be later installed in said mounting location.

5. The device of claim 4, further comprising means for removably attaching said calibration tool to said frame while adjusting said datum points.

6. The device of claim 5, wherein said reference member comprises a substantially flat surface and a cylindrical element mounted parallel to said substantially flat surface.

7. A method for aligning one or more thermal print heads to a print head assembly, comprising the steps of:

providing a frame comprising a reference member, and a multiplicity of adjustable datum points oriented orthogonally around a mounting location for a thermal print head;

providing a calibration tool having a first portion shaped like a thermal print head for placement in said mounting location and a rigid positioning member extending from said first portion;

locating said calibration tool with said first portion in said mounting location and said positioning member abutting said reference member of said frame for precisely position said first portion in said mounting location; and adjusting said datum points to determine a precise position for thermal print heads to be later installed in said mounting location.

8. The method of claim 7, further comprising the step of attaching said calibration tool to said frame during said step of adjusting.

9. The method of claim 8, further comprising the steps of removing said calibration tool from said frame after said step of adjusting and installing a thermal print head in said mounting location against adjusted datum points.

10. The method of claim 9, further comprising mechanically biasing a printer head installed in said mounting location against said datum points.

11. The method of claim 10, further comprising securing said printer head in said mounting location against said datum points.

* * * * *